United States Patent [19]

Marcocci et al.

[11] 4,121,397

[45] Oct. 24, 1978

[54] WOODEN BUILDING BRICKS

[76] Inventors: Guy D. Marcocci, Dudley, Pa. 16634; Peter Yablonski, Saxton, Pa. 16678

[21] Appl. No.: 797,425

[22] Filed: May 16, 1977

[51] Int. Cl.[2] ..... E04B 1/54

[52] U.S. Cl. ..... 52/286; 52/592

[58] Field of Search ..... 52/610, 609, 316, 594, 52/504, 606, 444, 605, 591, 233, 425, 566, 286, 316, 592; 249/127; 46/25, 26, 20

[56] References Cited

U.S. PATENT DOCUMENTS

| | | | |
|---|---|---|---|
| 295,692 | 3/1884 | Trochsler | 52/610 X |
| 547,159 | 10/1895 | Rosenzi | 52/286 X |
| 790,436 | 5/1905 | Inman | 52/610 |
| 901,798 | 10/1908 | Fenner | 52/610 |
| 1,436,551 | 11/1922 | Van Duzer | 52/609 |
| 1,671,279 | 5/1928 | Friedland | 52/286 X |
| 1,789,400 | 1/1931 | Brozek | 52/610 X |
| 1,981,324 | 11/1934 | Peterson | 52/610 X |
| 2,012,024 | 8/1935 | Roberts | 52/609 X |
| 2,198,011 | 4/1940 | Muirhead | 52/609 X |
| 2,214,657 | 9/1940 | Brown | 52/609 X |
| 2,285,026 | 6/1942 | Fulcher | 52/610 |
| 2,902,853 | 9/1959 | Lofstrom | 52/286 |
| 3,012,377 | 12/1961 | Sunukjian | 52/592 X |
| 3,304,674 | 2/1967 | Ward | 52/233 |
| 3,343,328 | 9/1967 | Rolle | 52/316 X |
| 3,410,044 | 11/1968 | Moog | 52/286 X |
| 3,422,588 | 1/1969 | Stewart, Jr. | 52/285 |
| 3,530,518 | 10/1970 | Zagray | 52/258 |
| 3,707,820 | 1/1973 | Leandri | 52/436 |

*Primary Examiner*—Alfred C. Perham
*Attorney, Agent, or Firm*—Cushman, Darby & Cushman

[57] ABSTRACT

An interlocking building block comprising a solid body of wood including a pair of spaced brick-shaped portions rigidly interconnected by a similarly shaped intermediate portion.

1 Claim, 7 Drawing Figures

Fig. 1
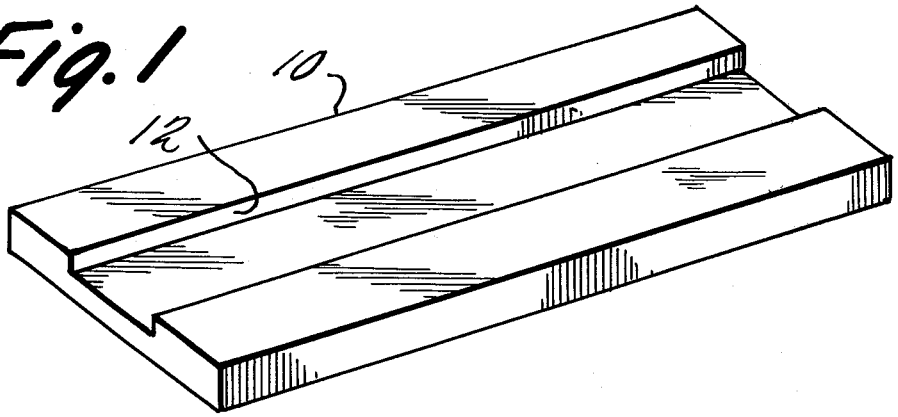
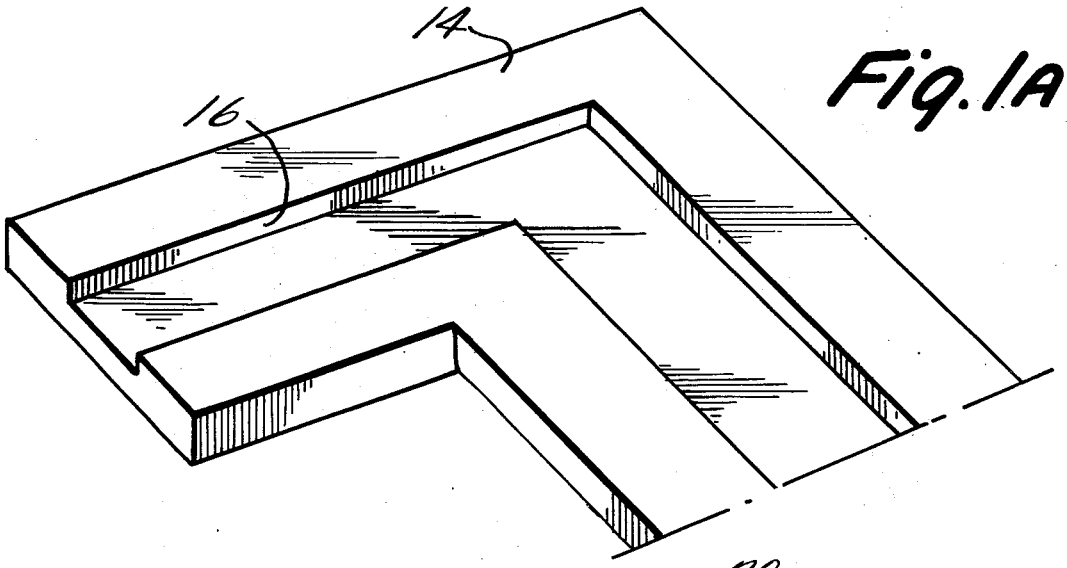
Fig. 1A
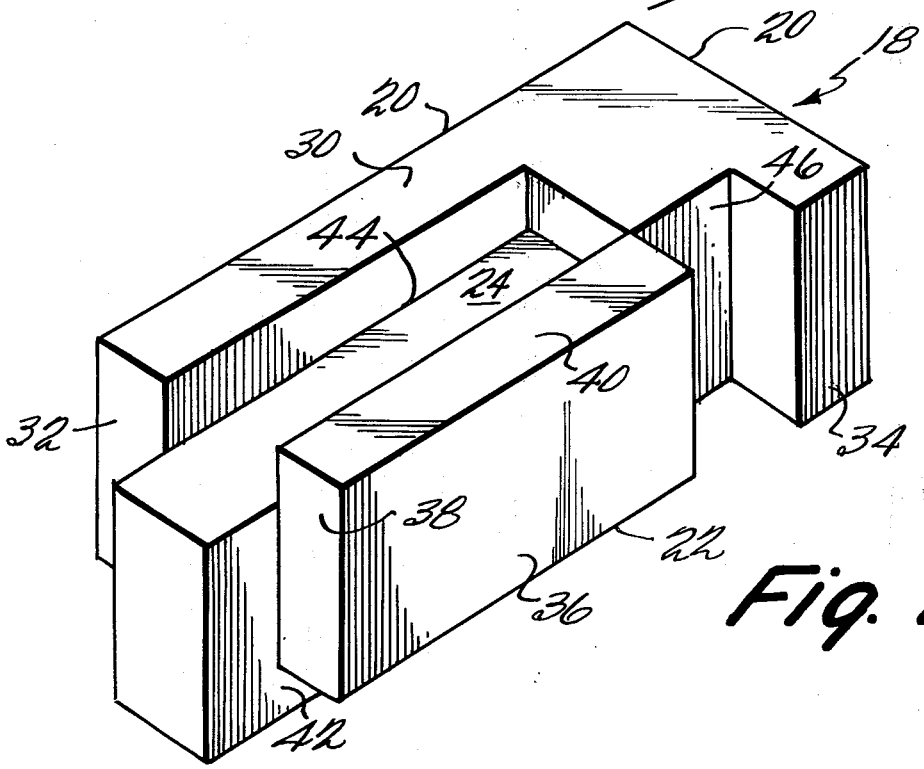
Fig. 2

Fig. 3
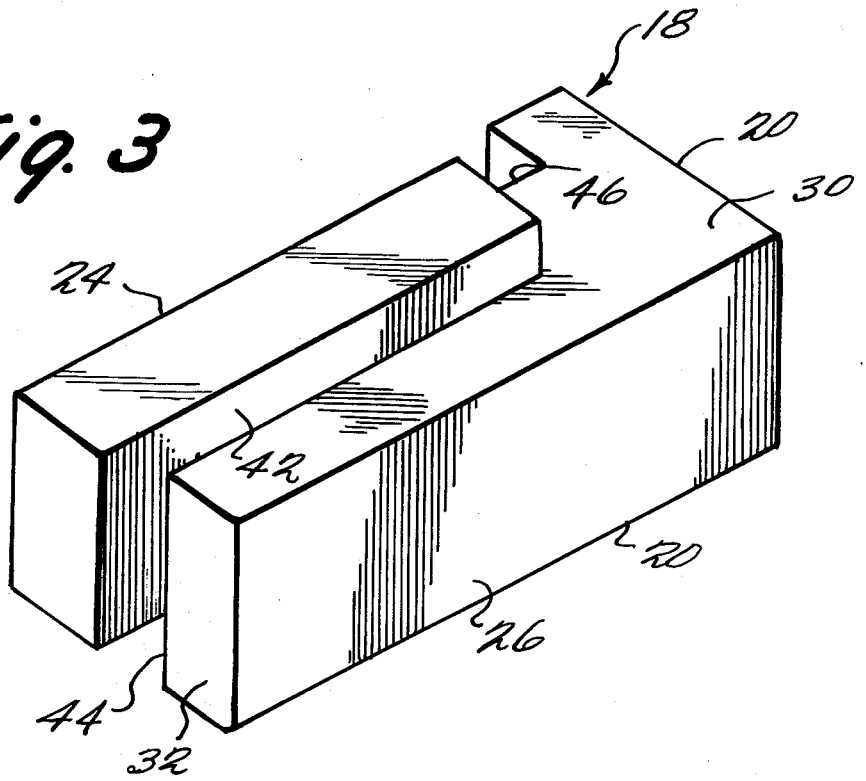
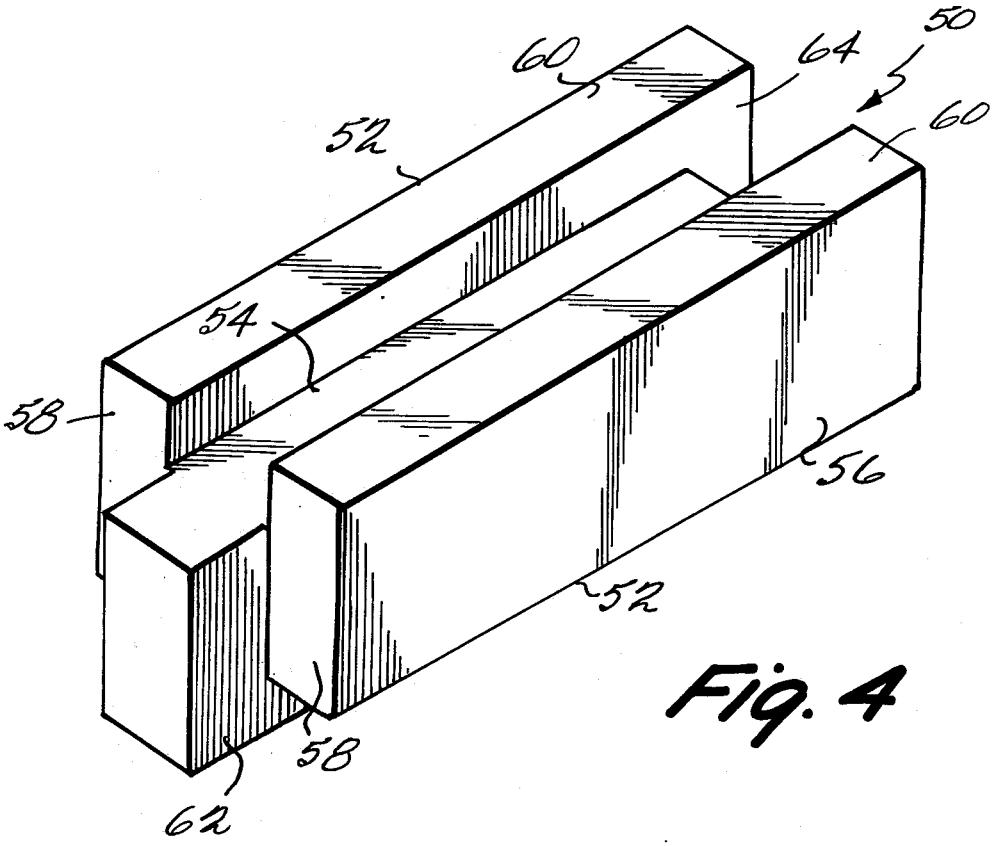
Fig. 4

WOODEN BUILDING BRICKS

This application is a substitute for application Ser. No. 671,154, filed Mar. 29, 1976, now abandoned.

This invention relates to a novel and useful interlocking building block or building brick, made from any materials used in the household as a decorative wall or to be used on the exterior of the house as a protective siding, or to be used as building blocks or bricks in miniature style for use as toys, and/or portable foundation for mobile home uses.

As is common knowledge, building blocks, building bricks or siding are used to cover the exterior and interior for beauty or to provide protection from different climatic changes. Our invention will provide the homeowner building blocks or bricks to utilize his or her expertise in building an interior wall or siding for their house without additional costs of a specialized contractor. In many building structures, the materials are not substantial in order to provide the strength needed for a product such as this, the precut interlocking block or brick of our invention will definitely support its own weight and will be self-secured without assistance of additional connections although nails, bonding application, adhesives and glues can be used.

The objective of our invention is to provide a building block which will be efficient in providing a siding as a much better insulator, to establish natural beauty, to assist the average person to erect the structure to exterior and interior walls of a house or any other structure, and be economical as to construction of the area to be covered. The building block or brick can be creosoted for exterior usage which will prevent deterioration of the product. The brick effect of the product will be produced by the beveling of the brick edge which gives the appearance of a mortar edge.

These and other objects of the present invention will become more apparent during the course of the following detailed description and appended claims.

The invention may best be understood with reference to the accompanying drawings wherein the illustrative embodiments are shown.

In the drawings:

FIG. 1 is a perspective view illustrating a straight base plate which can be utilized with the building blocks of the present invention;

FIG. 1A is a perspective view of a corner base plate which can be used with the building blocks of the present invention;

FIG. 2 is an isometric view of a corner block embodying the principles of the present invention;

FIG. 3 is an isometric view of the corner building block shown in FIG. 2 illustrating the same in a position inverted with respect to the position shown in FIG. 2;

FIG. 4 is an isometric view of a normal run building block embodying the principles of the present invention;

Figure 4A:
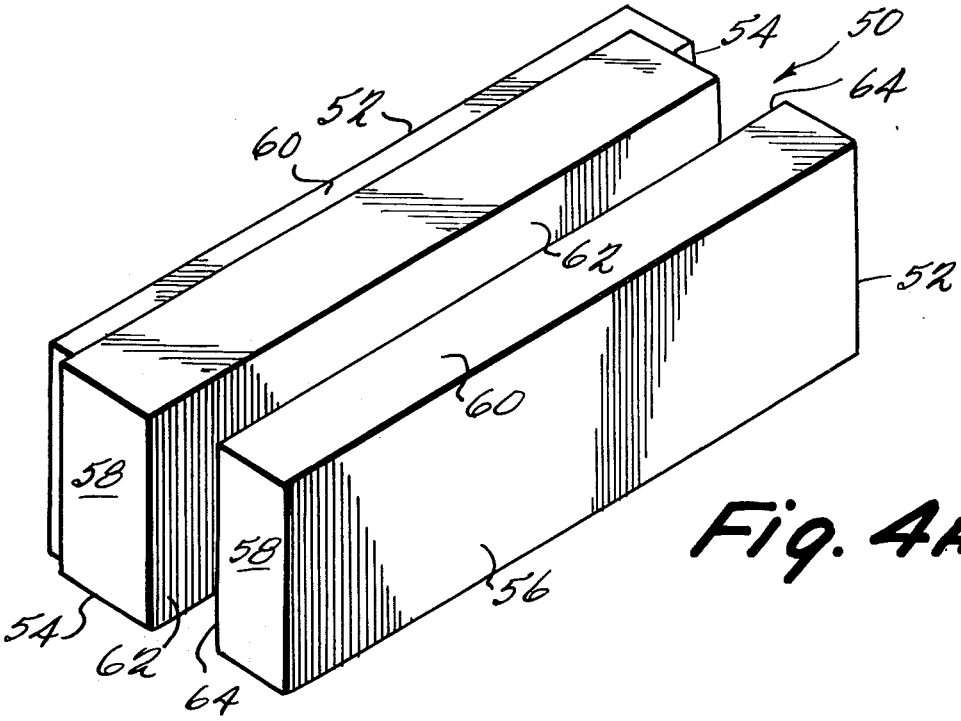
FIG. 4A is an isometric view of the building block shown in FIG. 4 illustrating the block in a position inverted with respect to the position shown in FIG. 4.

Referring now more particularly to FIG. 1 of the drawings, there is shown therein a straight base plate 10 upon which the building blocks of the present invention are mounted. The base plate 10 has a central groove 12 of rectangular cross-sectional configuration formed in the upper surface thereof. A corner base plate 14 is shown in FIG. 1A which has a similar central groove 16 of rectangular cross-sectional configuration formed in the upper surface thereof.

Referring now more particularly to FIGS. 2 and 3, there is shown therein an interlocking corner building block, generally indicated at 18, which embodies the principles of the present invention. The corner block 10 comprises a solid body of wood including an exterior portion 20 of generally L-shaped configuration in plan, a spaced interior portion 22 of generally rectangular shape in plan and an intermediate portion 24 rigidly interconnecting said exterior and interior portions.

Figure 5:
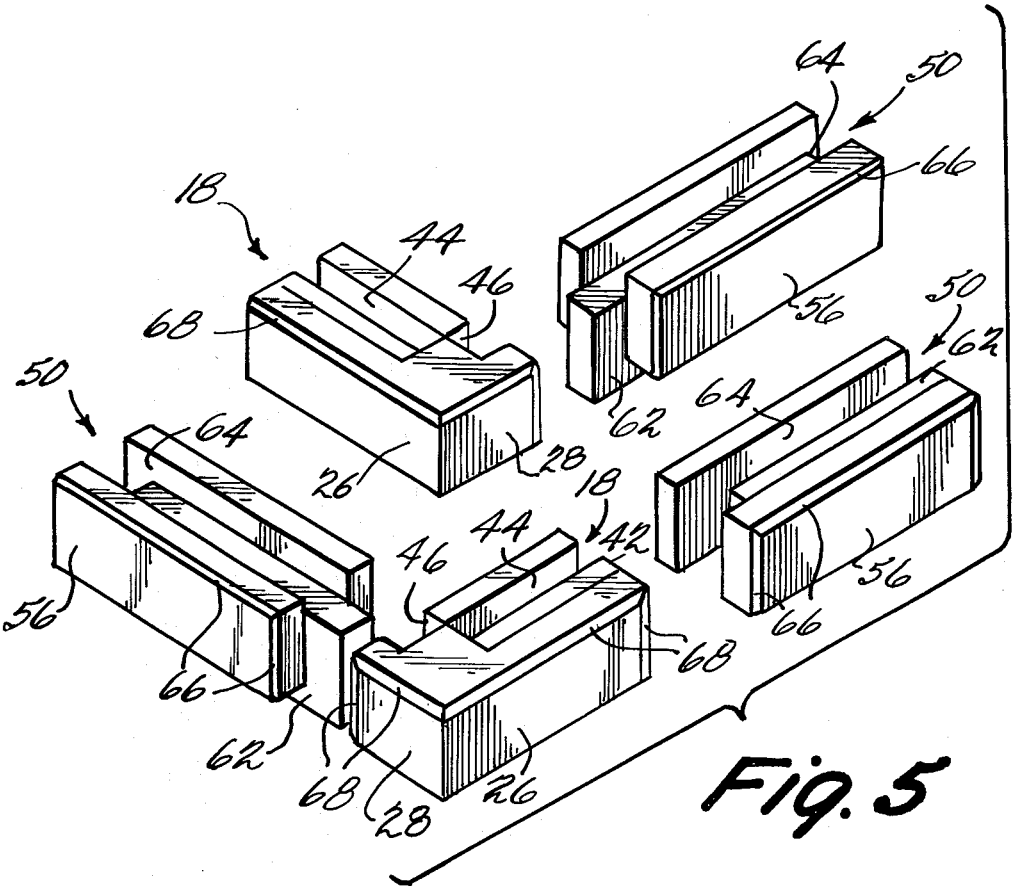
FIG. 5 is an exploded isometric view illustrating the manner in which the building blocks of the present invention are interlocked.

The exterior portion 20 has generally planar intersecting exterior surfaces 26 and 28 of rectangular configuration facing in directions which are perpendicular with respect to each other (see FIGS. 3 and 5). The rectangular exterior surfaces 26 and 28 have equal coextensive heights measured in the direction of intersection, the rectangular exterior surface 26 having a length generally twice the length of the other surface 28. The exterior portion 20 also has parallel planar side surfaces 30 extending inwardly along the length of the exterior surfaces 26 and 28 and two planar end surfaces 32 and 34. The end surface 32 extends inwardly of the free end of the rectangular exterior surface 26 in parallel relation to the rectangular exterior surface 28 and the end surface 34 extends inwardly of the free end of the rectangular exterior surface 28 in parallel relation to the rectangular exterior surface 26.

The interior portion 22 has a planar surface 36 disposed within a plane common with the end surface 34 of said exterior portion 20, a planar end surface 38 disposed in a plane common to the end surface 32 of the exterior portion 20 and parallel side surfaces 40 disposed in parallel planes common to the side surfaces 30 of the exterior portion 20.

The intermediate portion 24 provides an L-shaped tongue 42 of rectangular cross-sectional configuration between the end surface 38 of the interior portion 22 and the end surface 32 of the exterior portion 20 and two common adjacent side surfaces 30 and 40 of the exterior and interior portions respectively. The intermediate portion 24 also provides a first complementary groove 44 of rectangular cross-sectional configuration between the other two common end surfaces 30 and 40 of the exterior and interior portions respectively, the exterior, intermediate and interior portions having intersecting surfaces defining a second complementary groove 46 of rectangular cross-sectional configuration extending in a direction perpendicular to the first groove 44.

Referring now more particularly to FIGS. 4 and 4A, there is shown therein a normal run building block, generally indicated at 50, which embodies the principles of the present invention. The interlocking building block 50 comprises a solid body of wood including a pair of spaced brick-shaped portions 52 rigidly interconnected by a similarly shaped intermediate portion 54.

The brick-shaped portions 52 have parallel exterior surfaces 56 of rectangular configuration facing in opposite directions and aligned pairs of planar end and side surfaces 58 and 60 extending inwardly of the exterior surfaces 56.

The intermediate portion 54 is offset with respect to the brick-shaped portions 52 in one direction parallel with the side surfaces 60 thereof and in one direction parallel with the end surfaces 58 thereof so as to provide tongue sections 62 of rectangular cross-sectional configuration between the side and end surfaces of the brick-shaped portions 52 in the directions of offset and complementary grooves 64 of rectangular cross-sectional configuration between the side and end surfaces of the brick-shaped portion in the directions opposed to the directions of offset. As best shown in FIG. 5, at least one of the brick-shaped portions 52 is formed with a beveled peripheral surface 66 between the exterior surface 56 thereof and the end and side surfaces 58 and 60 thereof. A similar beveled peripheral surface 68 is formed in the corner block between the intersecting exterior surfaces 26 and the associated end surfaces 32 and 34 and side surfaces 30.

The manner in which the building blocks 18 and 50 are interengaged to form a wall or barrier is believed apparent from viewing FIG. 5, which is an exploded view.

What is claimed is:

1. An interlocking corner building block comprising a solid body of wood including an exterior portion of generally L-shaped configuration in plan, a spaced interior portion of generally rectangular shape in plan and an intermediate portion rigidly interconnecting said exterior and interior portions, said exterior portion having generally planar intersecting exterior surfaces of rectangular configuration facing in directions which are perpendicular with respect to each other, said rectangular exterior surfaces having equal coextensive heights measured in the direction of intersection, one of said rectangular exterior surfaces having a length generally twice the length of the other, said exterior portion having parallel planar side surfaces extending inwardly along the length of said exterior surfaces and two planar end surfaces one of which extends inwardly of the free end of said one rectangular exterior surface in parallel relation to the other rectangular exterior surface and the other of which extends inwardly of the free end of the other rectangular exterior surface in parallel relation to said one rectangular exterior surface, said interior portion having a planar surface disposed within a plane common with said other end surface of said exterior portion, a planar end surface disposed in a plane common to said one end surface of said exterior portion, a first groove side defining surface disposed in parallel relation to said end surface of said interior portion and facing in the opposite direction and parallel side surfaces disposed in parallel planes common to the side surfaces of said exterior portion, said intermediate portion having parallel rectangular planar surfaces disposed in abuting alignment with said parallel planar side surfaces of said exterior portion, said intermediate portion providing an L-shaped tongue of rectangular cross-sectional configuration between the end surface of said interior portion and said one end surface of said exterior portion and two common adjacent side surfaces of said exterior and interior portions and a first complementary groove of rectangular cross-sectional configuration between the other two common end surfaces of said exterior and interior portions, said first complementary groove being open at one end and defined at its other end by an end wall disposed in general alignment with one end of said L-shaped tongue and in intersecting relation with the associated rectangular planar surface of said intermediate portion, the bottom of said first complementary groove being defined by a surface disposed in aligned relation with the opposite end of said L-shaped tongue, said exterior portion having a second groove side defining surface disposed in parallel relation with and facing toward said first groove side defining surface, said intermediate portion having a groove bottom defining surface disposed in parallel relation with the planar surface of said interior portion and intersecting at its ends with the rectangular surfaces of said intermediate portion and at its sides with said first and second groove side defining surfaces so as to define therewith a second complementary groove of rectangular cross-sectional configuration open at both ends, said exterior portion being formed with a beveled peripheral surface between said exterior surfaces and the end and side surfaces thereof.

* * * * *